US006118950A

United States Patent [19]

Wibbels et al.

[11] Patent Number: 6,118,950

[45] Date of Patent: Sep. 12, 2000

[54] DUPLEX IMAGE ALIGNMENT

[75] Inventors: Mark Wibbels; Kenneth E. Heath, both of Boise; Victor Loewen, Eagle, all of Id.

[73] Assignee: Hewlett-Packard Company, Palto Alto, Calif.

[21] Appl. No.: 09/340,712

[22] Filed: Jun. 29, 1999

[51] Int. Cl.[7] ..... G03G 15/00

[52] U.S. Cl. ..... 399/16; 399/364; 399/394

[58] Field of Search ..... 399/15, 16, 9, 399/43, 45, 38, 72, 81, 301, 361, 364, 394; 358/1.18, 401

[56] References Cited

U.S. PATENT DOCUMENTS

| | | | |
|---|---|---|---|
| 4,831,420 | 5/1989 | Walsh et al. | 399/16 |
| 5,646,744 | 7/1997 | Knox | 358/401 |
| 5,666,208 | 9/1997 | Farrell et al. | 399/81 X |

*Primary Examiner*—Sophia S. Chen

*Attorney, Agent, or Firm*—Lane R. Simmons

[57] ABSTRACT

A method of aligning duplex images on an imaging device such as a printer or copier includes duplex imaging a test sheet having indicia on each side of the sheet that communicate, when observed in a single visual context, duplex imaging adjustment parameters for the imaging device. The method further includes modifying imaging parameters of the imaging device based on the duplex imaging adjustment parameters communicated. The indicia on each side of the sheet are seen in a single visual context by observing certain of the indicia through the media, as when the media is held up to a light source. In a preferred embodiment, the indicia on each side of the sheet includes respective portions of a vernier scale. The imaging parameters are modified by entering the adjustment parameters at a control panel of the imaging device. Imaging parameters modified include timing parameters associated with the process of writing data on the imaging device. In addition to the method, an imaging device includes components, data and executable instructions necessary for implementing the above described method.

28 Claims, 5 Drawing Sheets

DUPLEX IMAGE ALIGNMENT

FIELD OF THE INVENTION

This invention relates in general to image forming devices and, more particularly, to aligning duplex images on a printer.

BACKGROUND OF THE INVENTION

As conventional in the art, simplex printing includes printing or imaging only a single side of a page or sheet of media. However, duplex printing includes printing or imaging both sides of the page or sheet media. Both simplex and duplex printing are well known in the art of printers, copiers, facsimile devices and the like.

With duplex printing, the alignment of the images on the front and back side of the page is critical. For example, when a stack of pages is folded to make a booklet, the back side of page one will share a margin with the front side of page two. Thus, any misalignment of the front and back images will produce an undesirable visible step at the margin.

Conventional image alignment or registration technologies focus on making the registration or image placement for each side of a page correct so that the front and back images will align correctly. However, to achieve acceptable simplex registration so that the duplexed pages are also acceptably aligned is prohibitively complex and expensive.

In addition, increasing the consistency of the simplex registration to improve the duplex registration can not compensate for small errors in paper size. Since the duplex process flips the page to image the second side, both edges of the page (relative to the media processing direction in the imaging device) are used for positioning the page in the printer. Thus, if the dimension of the paper varies or is incorrect relative to a given size, the front and back side images will be shifted by the amount of the page dimension error. Although a paper dimension error may be small, such small errors in front to back image alignment are very visible.

Accordingly, an object of the present invention is to provide a method and system for duplex image alignment.

SUMMARY OF THE INVENTION

According to principles of the present invention in a preferred embodiment, a method of aligning duplex images on an imaging device such as a printer or copier includes imaging first demarcation elements on a first side of a media, imaging second demarcation elements on a second side of the media, comparing the first and second demarcation elements in a single visual context to determine which first demarcation element most closely aligns with which second demarcation element, determining correction indicia based on which first demarcation element most closely aligns with which second demarcation element, and modifying imaging parameters of the imaging device based on the correction indicia. The first and second demarcation elements are seen in a single visual context by observing the second demarcation elements through the media, as when the media is held up to a light source.

Also in a preferred embodiment, the first demarcation elements include a first portion of a vernier scale, and the second demarcation elements include a second portion of the vernier scale. Additionally, the correction indicia is entered at a control panel of the imaging device and used by the device firmware to modify imaging parameters to shift front and back (duplex) images on a sheet into proper alignment with respect to each other. Specifically, imaging parameters modified include timing parameters associated with the process of writing data on the imaging device.

According to further principles of the present invention, an imaging device includes components, data and executable instructions necessary for implementing the above described method.

Other objects, advantages, and capabilities of the present invention will become more apparent as the description proceeds.

DETAILED DESCRIPTION OF THE INVENTION

Figure 1:
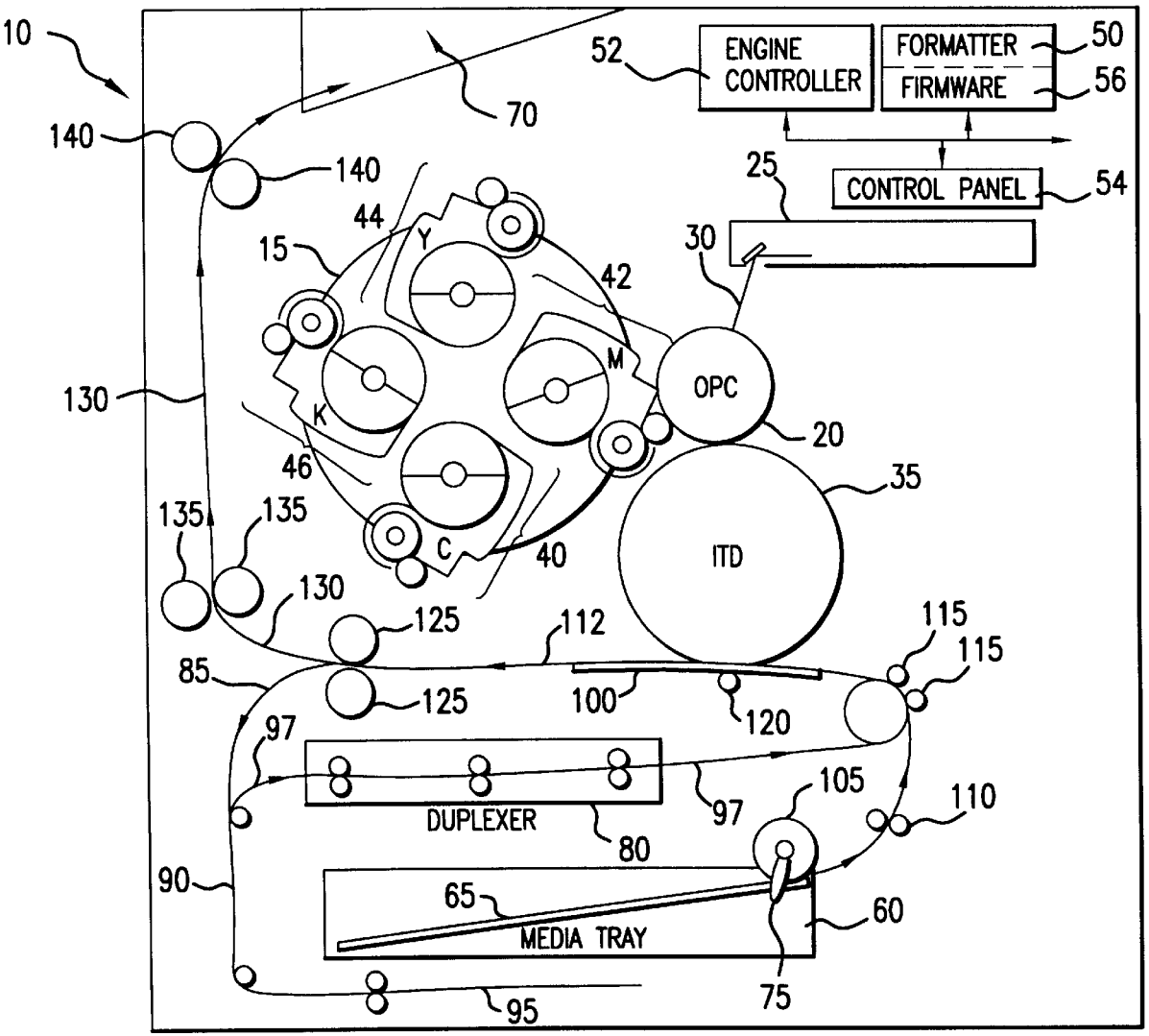
FIG. 1 is a cross sectional view in schematic diagram of a color laser printer employing principles of the present invention for duplex image alignment.

FIG. 1 is a cross sectional view in schematic diagram of an imaging device 10 employing principles of the present invention. Although imaging device 10 is shown and discussed herein as a carousel based color laser printer having duplexing capabilities, it will be understood by those of ordinary skill in the art that the present invention is equally applicable to other image forming devices, color or monochrome, such as inkjet printers, photocopiers, facsimile machines and the like, and to in-line color electrophotographic (EP) devices, EP devices using an intermediate transfer belt or using no intermediate transfer mechanism, single or dual heated fusing roller configurations, and also to duplexing mechanisms, paths and configurations beyond that shown and described herein. Additionally, the discussion of sheet media in general is understood to include opaque and transparent media whether it be paper sheets, plastic sheets such as overhead transparencies, vellum sheets, envelopes, cardstock and the like, as is conventionally processed in imaging devices. Moreover, many conventional components are omitted from the drawing to maintain clarity with respect to the general interplay of components and media processing paths for duplex printing as they relate to the present invention.

Now, in continued reference to FIG. 1, printer 10 is a color laser printer and includes developer carousel 15, optical photoconductive drum (OPC) 20, laser optics 25, laser beam 30 for discharging drum 20, and intermediate transfer drum (ITD) 35. A cyan (C) developer 40, magenta (M) developer 42, yellow (Y) developer 44 and black (K) developer 46 are each mounted on developer carousel 15 in a respective developer station. Formatter 50 receives print data from a host system (not shown) and forms a raster print data stream. The raster print data stream is sent to engine controller 52 for conversion to a format suitable for controlling the pulsing of laser beam 30. Control panel 54 is disposed on an external surface of printer 10 and coupled to formatter 50 for enabling a user to directly interact with and control printer 10. Control panel 54 includes buttons, switches, or the like, and a display area such as a liquid crystal display (LCD). Firmware 56 stores data and routines to enable the operation of printer 10. Importantly, firmware 56 includes data, routines and/or executable instructions for enabling duplex image alignment on printer 10 under principles of the present invention. It should be noted, however, that the data, routines and/or executable instructions stored in firmware 56 for enabling the present invention may also be implemented in software or designed into hardware components as is obvious to those of ordinary skill in the art.

Printer 10 further includes media input tray 60 and biased bed 65 for holding sheet media to be processed through the printer. Output tray 70 receives the image processed media. Although printer 10 is shown with one input tray 60 and one output tray 70, it is obvious that multiple input or output trays are feasible. Sensor 75 detects whether media is available on bed 65. Duplexer 80 and duplexing sheet media path 85, 90, 95, 97 enables duplex imaging in printer 10.

Printer 10 forms a printed image onto sheet media 100 by first printing one of the four color planes CMYK onto photoconductive drum 20 and then immediately transferring that plane image to ITD 35. Once transferred, a next color plane is printed onto drum 20 and then also immediately transferred to ITD 35 over the previous color plane image. This process is repeated for each color plane required to form the image. Once all color planes are printed onto ITD 35, they are transferred to sheet media 100 to form a full color image thereon.

To further explain the general workings of printer 10, upon initiation of a single sided (non-duplex) print job, sheet 100 is picked from bed 65 by pick roller 105 and passed through transport rollers 110 and skew rollers 115 to transfer roller 120 and ITD 35 for imaging of the sheet on a first side. Once the image is transferred to the first side, sheet 100 continues along media processing path 112 on through fuser rollers 125 where the toner is fused to the sheet. Subsequently, sheet 100 is passed along media path 130 through transport rollers 135, 140, and finally to output bin 70.

Upon initiation of a duplex print job, the same initial processing path 112 just described for non-duplex printing is followed. However, the second side ("back" side) of sheet 100 is imaged first and then the sheet is directed down into duplexing path 85, 90, 95. Subsequently, sheet 100 is brought back up path 95 and 90 to path 97 for capture and sheet alignment by duplexer 80. Then, when data is ready for imaging on the first side ("front" side) of sheet 100, the sheet is transported further up path 97, through skew rollers 115, and back to transfer roller 120 for imaging of the first side. The first side is now presented for imaging because of the inverting effect that occurred to the sheet due to it having been drawn down through duplexing path 85, 90, 95 and back through path 97 and duplexer 80. Subsequently, the first side is fused 125 and the sheet continues up path 130 and is ejected into output bin 70 with its first ("front") side facing down.

Now, under principles of the present invention, printer 10 produces visually aligned duplex images, i.e., a front side image of a sheet media is visually aligned with a back side image of the sheet, by generating a test sheet duplex page having indicia on each side of the page that communicates adjustment parameters for printer 10 for aligning duplex images. In a preferred embodiment, sheet media 100 is a conventional, non-opaque media that enables a visual detection of an image formed on a back side of the sheet when the sheet is viewed from the front side, such as when the sheet is held up to a light source. Also in a preferred embodiment, the indicia printed on each side of sheet 100 includes portions of a vernier scale having adjustment indicators indicative of incremental adjustments to be made to printer 10 for aligning images on a duplexed sheet. The vernier scale imaged on the front side is visually inspected by a user relative to the portion of the scale imaged on the back side that is seen through the sheet. Based on the repeatable misalignment of the scales, selected adjustment indicators are manually entered into printer 10 via control panel 54 and firmware 56 to modify/correct duplex image alignment (registration) parameters of printer 10.

Figure 2:
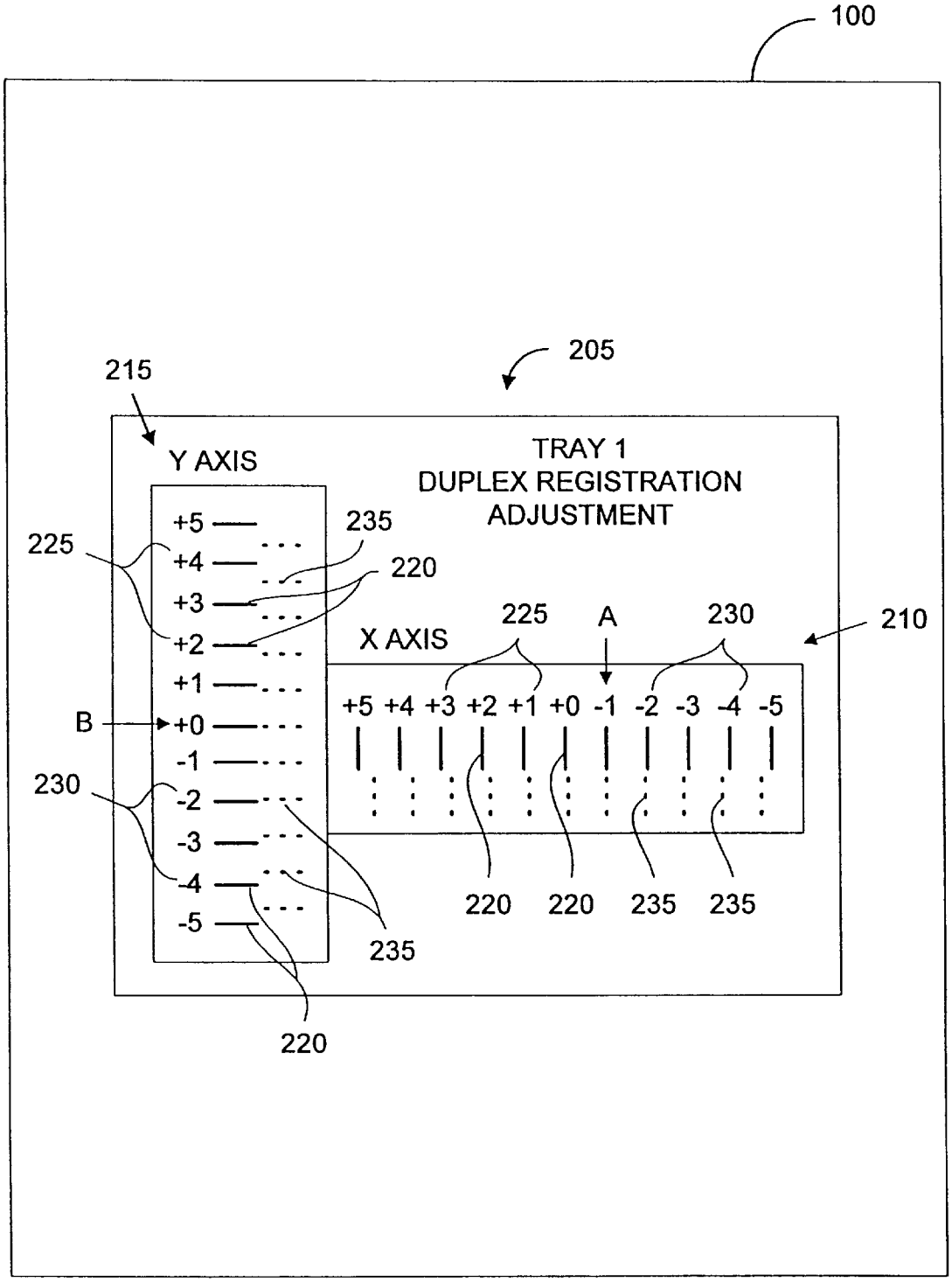
FIG. 2 is a diagram of a vernier scale as duplex imaged on a sheet of media by the printer of FIG. 1, including a first portion of the scale imaged on a front side of the media and a second portion of the scale imaged on a back side of the media and being visible through the media (shown in broken lines).

Referring now to FIG. 2, a preferred vernier scale 205 is depicted as implemented by the present invention on test sheet 100 for duplex image alignment. Although vernier scale 205 depicts a preferred embodiment under the present invention, other demarcation configurations or elements are similarly applicable. Scale 205 includes X and Y axis alignment indicia 210, 215 respectively, as printed on a first (front) side of sheet 100. In an alternate embodiment, only X axis or only Y axis alignment indicia is printed on sheet 100. In yet a further alternate embodiment, each axis is imaged onto a separate sheet; in other words, the X axis indicia is imaged onto a first sheet, and the Y axis indicia is imaged onto a second sheet.

In a preferred embodiment as shown, each demarcation line (element) 220 of each axis is identified with label or correction indicia 225, 230 indicative of a correction parameter or value for adjusting the duplex alignment of printer 10. To retain clarity in the drawing, only a selected few of the demarcation lines in each axis is identified with the reference number 220. In the embodiment shown, the label indicia are positive and negative correction value numbers 225, 230. However, other labels or correction indicia are similarly feasible, whether clearly indicative of an actual correction value or not. For example, alphabetic, alphanumeric or other graphically defined labels can be arbitrarily assigned to each demarcation line 220. Alternatively, the demarcation lines themselves are formed as label indicia. But in any case, whatever the indicia or label used, it is indicative of a parameter that is entered into (or identified at) control panel 54 for modifying the duplex imaging alignment characteristics of printer 10.

On the second (back) side of sheet 100, a second portion of vernier scale 205 is duplex imaged by printer 10 and also includes X and Y axis alignment indicia (demarcation lines) 235 respectively. Again, to retain clarity in the drawing, only a selected few of the demarcation lines in each axis is identified with the reference number 235. Demarcation lines 235 are shown in broken lines to indicate that, although they are printed in solid lines on the back side of sheet 100, they are being seen through sheet 100 as viewed from the front side of the sheet. In this context, lines 235 are best seen when sheet 100 is not completely opaque, but retains at least some transparency characteristics such as is found in conventional white sheet media commonly used in printers and copiers. Additionally, lines 235 are best seen when sheet 100 is held up to a light source.

The distance established between each demarcation line 220 is determined based on known duplex print alignment variations (errors) that typically occur with respect to printer 10. In a preferred embodiment, that known value is roughly doubled as a basis for establishing a preferred distance between each demarcation line 220. For example, if it is known from testing or specification reporting that printer 10 carries a duplex print alignment variation (error) of about four (4) mm (i.e., a simplex print alignment variation (error) of about two (2) mm), then the distance between demarcation lines 220 is set at about ten (10) mm. This increased distance between demarcation lines of vernier scale 205 enables a non-ambiguous correction value 225, 230 to be determined, regardless of which way the front and back images have moved relative to each other when misaligned.

Vernier scale 205 is visually examined for alignment in both the scan (X axis) and process (Y axis) directions, and the correction value 225, 230 associated with the demarcation lines 220, 235 on vernier scale 205 which line up on the front and the back of the page is entered on control panel 54 of printer 10. To this regard, in FIG. 2, the "A" referenced demarcation lines 220, 235 that are associated with correction value "−1" on the X axis, and the "B" referenced demarcation lines 220, 235 that are associated with correction value "+0" on the Y axis, are most closely aligned. Thus, a "−1" is entered at control panel 54 to correct the registration/alignment for the X axis, and "+0" is entered (or not entered, being indicative of no alignment correction needed) at the control panel for the Y axis. With these correction values entered, printer 10 appropriately modifies its printing characteristics via firmware 56 by shifting the front and back side images to print a more accurately aligned duplex image subsequent to test sheet 100.

It should be noted here again that the vernier scale 205 depicted in FIG. 2 is merely exemplary of reference indicia that may be employed under the present invention for duplex alignment/registration purposes. For example, although demarcation lines 220, 235 are shown as straight lines, other marks are similarly feasible, such as arrows, caret characters, "plus" characters, diamond shaped characters, or the like, but preferably include a mark or marks that are visually detectable as aligned or not aligned relative to each other (i.e., front side marks relative to back side marks). Additionally, under the present invention, a vernier scale 205 is produced for each media tray 60 that is employed by printer 10. Thus, as an example, since printer 10 embodies only one media tray 60, only a single test sheet 100 is produced having vernier scale 205 duplexed thereon. On the other hand, if an imaging device embodies two media trays, a vernier scale alignment/adjustment sheet is printed specific to each media tray.

Figure 3A:
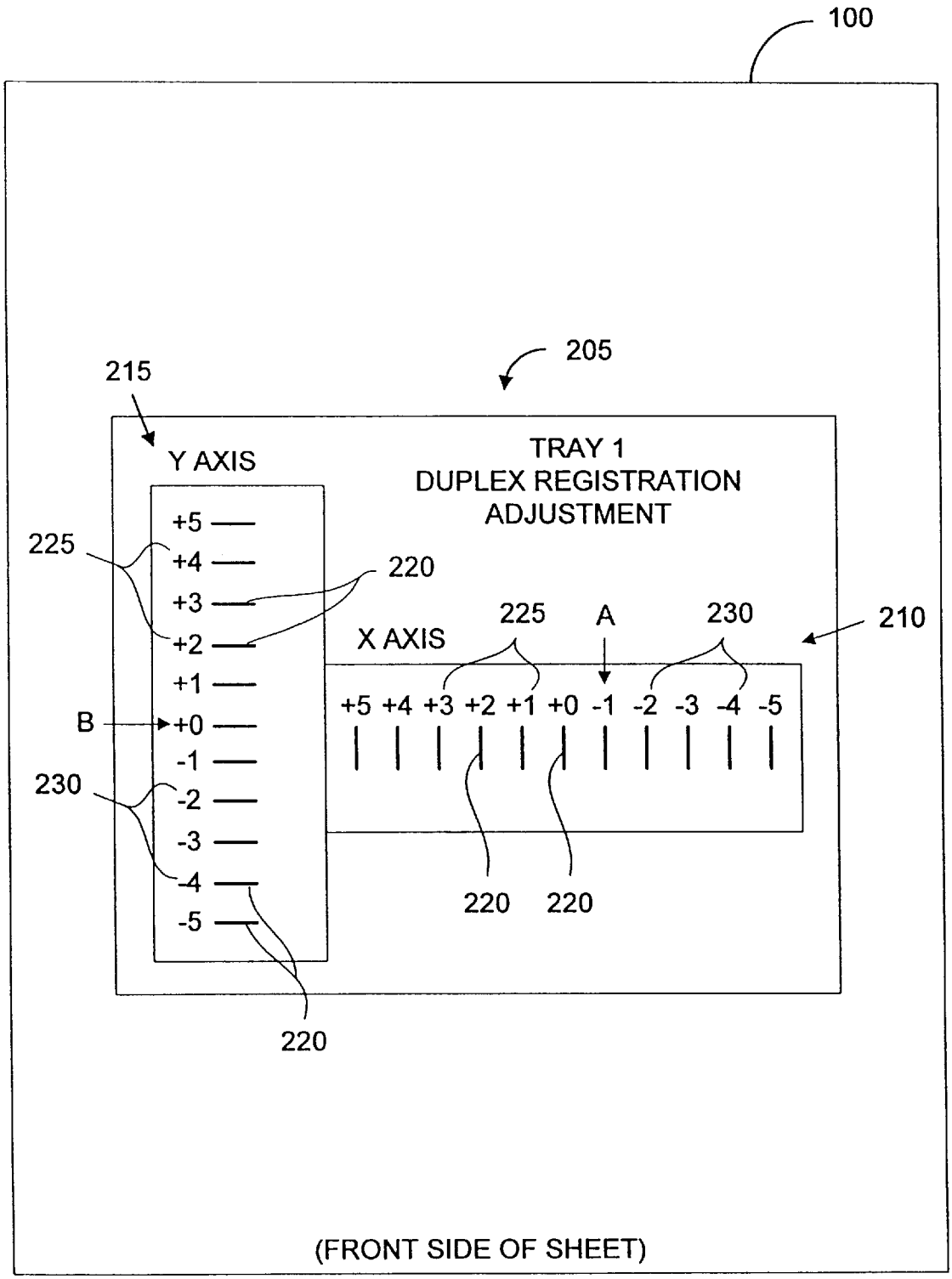
FIG. 3A is a diagram of the first portion only of the vernier scale of FIG. 2 as imaged on the front side of the sheet media.

FIG. 3A is a diagram of the first portion only of the vernier scale of FIG. 2 as imaged on the front side of sheet 100.

Figure 3B:
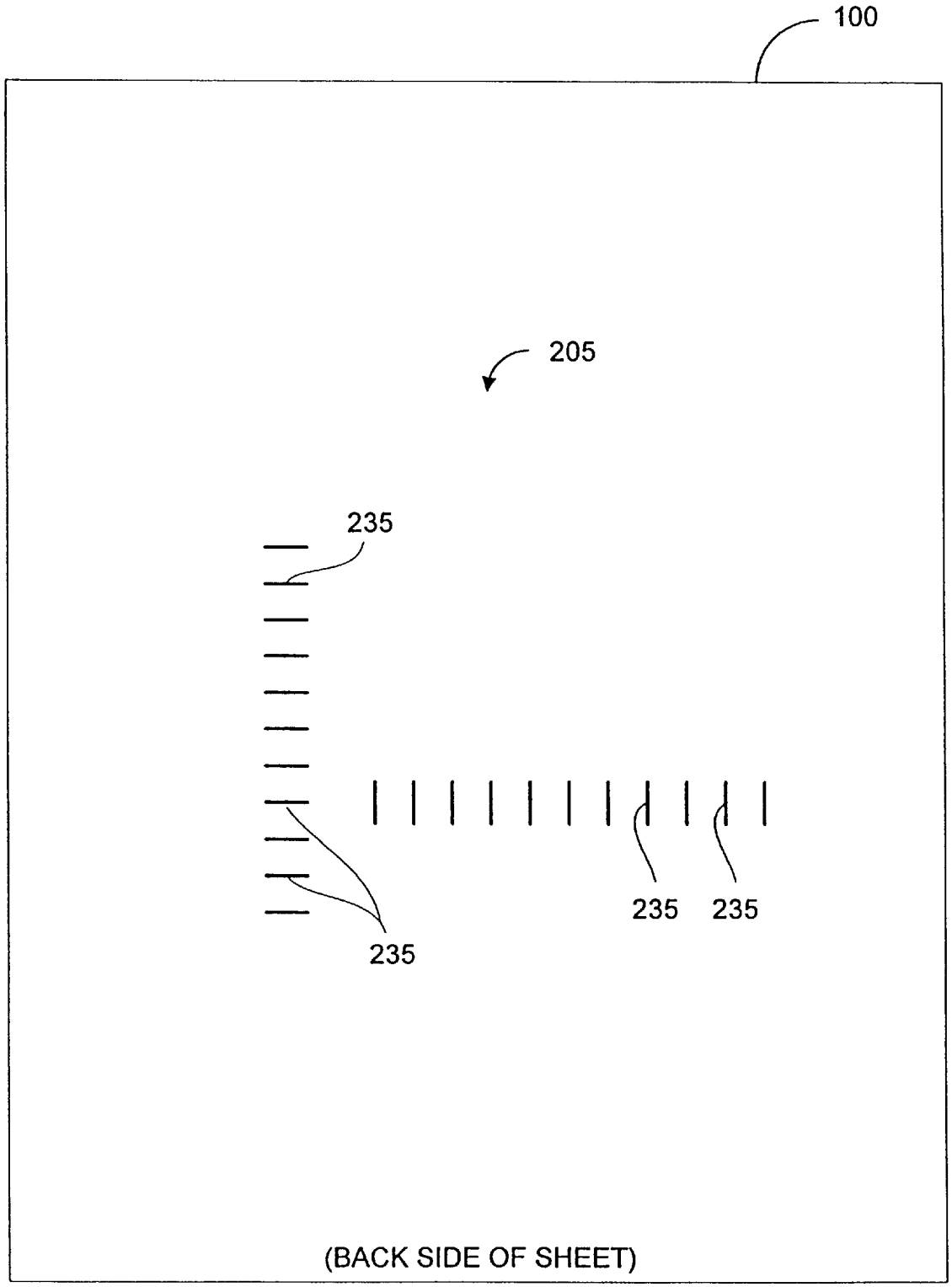
FIG. 3B is a diagram of the second portion only of the vernier scale of FIG. 2 as imaged on the back side of the sheet media.

FIG. 3B is a diagram of the second portion only of the vernier scale of FIG. 2 as imaged on the back side of sheet 100.

Figure 4:
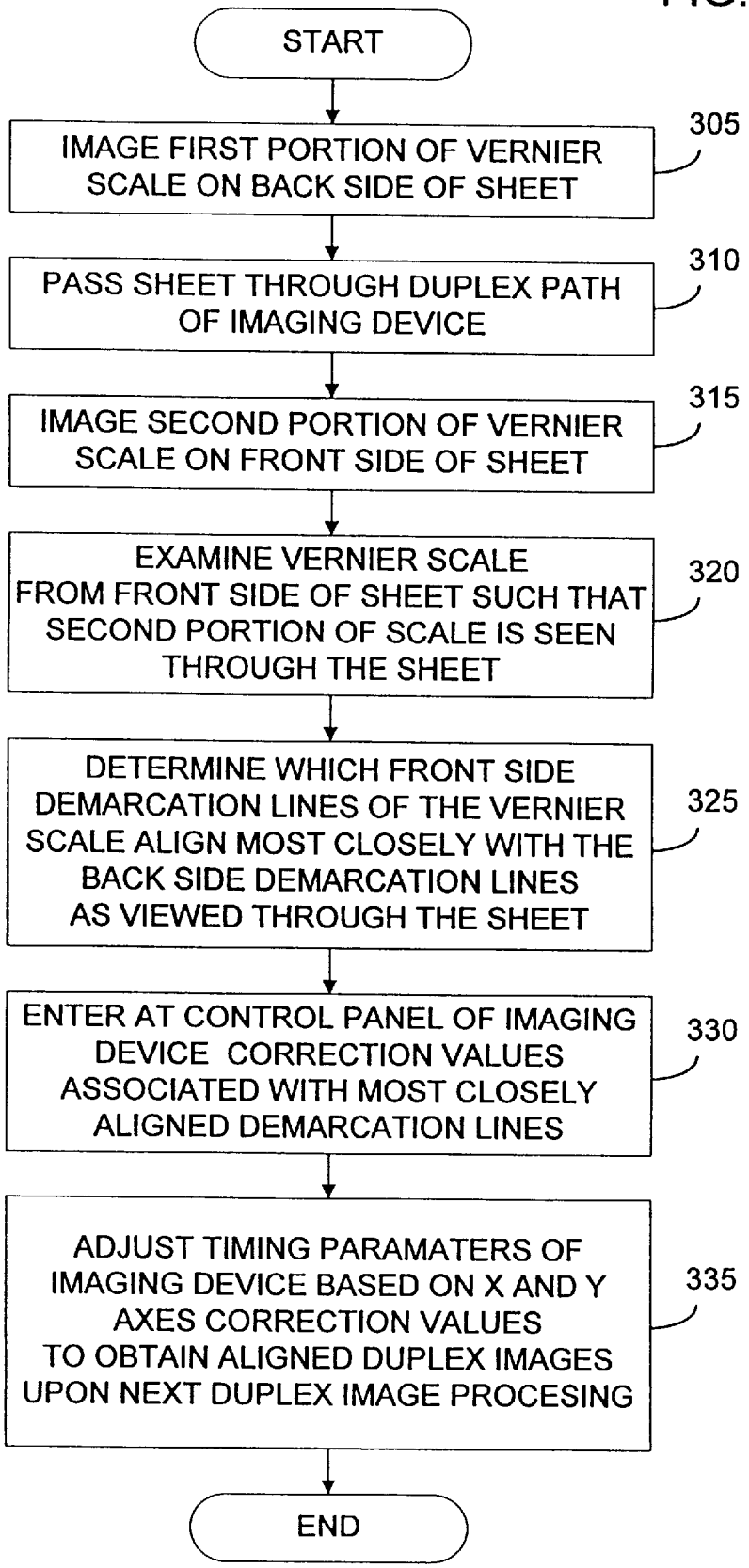
FIG. 4 is a flow chart depicting a preferred method of the present invention.

Referring now to FIG. 4, a flow chart depicts a preferred method of the present invention. In discussing FIG. 4, pertinent elements of FIG. 1, FIG. 2, FIG. 3A and FIG. 3B will also be referenced where appropriate. Preliminarily, 305, printer 10 images a first portion of vernier scale 205 on a back side of sheet 100 (see FIG. 3B). Next, 310, the sheet is passed through duplexing path 85, 90, 95, 97 and then a second portion of vernier scale 205 is imaged 315 on the front side of sheet 100 (see FIG. 3A).

It should be noted here that the use of "front" side or "first" side in this description are relative terms. In other words, under principles of the present invention, it is insignificant which side of sheet 100 is imaged first or which portion of scale 205 is imaged on which side of sheet 100. For example, many duplex capable laser printers image the "back" side of a sheet first, then pass the sheet through the duplexer path 85, 90, 95, then image the "front" side of the sheet and pass the sheet on out to eject face down in an output bin 70. On the other hand, other imaging devices may reverse the role. However, regardless of the duplex imaging order/scheme employed, the important principles under the present invention are that a first portion of some measurement capable indicia be imaged on one side of a sheet, and a second portion be imaged on the other side of the sheet, all in such a manner that when one portion of the indicia is viewed face on from one side of the sheet, the other portion of the indicia on the other side of the sheet is seen through the sheet such that both portions are observed in a single visual context with each other.

After sheet 100 is duplex imaged, a user examines 320 vernier scale 205 from the front side (preferably) such that both front and back side imaged portions of the vernier scale are seen together in a single context (the back side portion of the vernier scale being seen through the sheet from the front side). Next, 325, it is determined which front side demarcation lines 220 of vernier scale 205 align most closely with which back side demarcation lines 235 as viewed through the sheet. Again, in reference to FIG. 2, the demarcation lines 220, 235 associated with the correction value of "−1" (identified with reference label "A" in the figure) are most closely aligned in the X axis 210, and the demarcation lines 220, 235 associated with the correction value of "+0" (identified with reference label "B" in the figure) are most closely aligned in the Y axis 215. Subsequently, the correction values 225, 230 of "−1" for the X axis and "+0" for the Y axis are entered 330 at control panel 54 for use by firmware 56 and printer 10.

Finally, with the correction values entered 330, firmware 56 shifts front and back side images by adjusting timing parameters 335 of printer 10 for writing of subsequent images to ensure correct alignment during further duplex image processing. For example, in a preferred embodiment, image placement in the scan direction (X axis) is modified by changing the delay between receiving a beam detect signal and the start of image data (the beam detect signal being associated with beam 30 beginning scanning along OPC 20, and the start of image data being associated with pulsing beam 30 to discharge OPC 20 to generate a latent image thereon). On the other hand, image placement in the process direction (Y axis) is modified by increasing or decreasing the number of beam detects which occur between the first beam detect signal (at the top of page) and the start of image data. Alternatively, process direction image placement is adjusted by modifying the timing between the paper feed signal for the transfer of the paper (relative to media tray 60 or duplexer 80) and the start of image formation using beam 30. However, clearly, other methods are similarly feasible for adjusting the X and Y axis duplex imaging in response to correction values 225, 230. Additionally, image placement modifications are made relative to the imaging device being used. For example, if a Light Emitting Diode (LED) array print head is used instead of a laser beam in any given imaging device, image placement in the scan direction (X axis) may be modified by a pixel shifting process. Namely, imaging is started at an LED offset, such as at LED #5 rather than LED #1.

Finally, it will be obvious to one of ordinary skill in the art that the present invention is easily implemented utilizing any of a variety of components and tools existing in the art. Moreover, while the present invention has been described by reference to specific embodiments, it will be apparent that other alternative embodiments and methods of implementation or modification may be employed without departing from the true spirit and scope of the invention.

What is claimed is:

1. A method of aligning duplex images on an imaging device, comprising:

(a) comparing, in a single visual context, first indicia on a first side of a media with second indicia on a second side of the media, both indicia having been imaged by the imaging device; and, (b) modifying imaging parameters of the imaging device based on correction indicia detected from the comparing.

2. The method of claim 1 wherein the first indicia includes a first portion of a vernier scale and the second indicia includes a second portion of the vernier scale.

3. The method of claim 2 wherein the comparing includes visually comparing first demarcation elements embodied in the first portion of the vernier scale with second demarcation elements embodied in the second portion of the vernier scale to identify certain of the first demarcation elements that most closely align with certain of the second demarcation elements, the second demarcation elements being visually detected through the media.

4. The method of claim 1 wherein the first indicia includes first demarcation elements and the second indicia includes second demarcation elements.

5. The method of claim 1 wherein the correction indicia is associated with the first indicia.

6. The method of claim 5 further including entering the correction indicia into the imaging device at a control panel of the imaging device for modifying the imaging parameters of the imaging device.

7. The method of claim 1 wherein the imaging parameters include timing parameters associated with a process of imaging data on the imaging device.

8. The method of claim 1 wherein modifying imaging parameters includes modifying, for image shifting in a scan direction, a delay time between: (i) receiving a beam detect signal associated with a scan line to be imaged, and (ii) a start of image data for the scan line.

9. The method of claim 1 wherein modifying imaging parameters includes modifying, for image shifting in a process direction, a number of beam detects which occur between: (i) a first beam detect signal that is indicative of a top of page, and (ii) a second beam detect signal that is indicative of a start of image data.

10. The method of claim 1 wherein modifying imaging parameters includes modifying, for image shifting in a process direction, a timing between: (i) a media feed signal for a transfer of media in the imaging device, and (ii) a start of image data.

11. The method of claim 1 wherein the imaging device is a printer, copier or facsimile machine.

12. A computer-readable medium having computer-executable instructions for performing steps for aligning duplex images on an imaging device, the steps comprising:

(a) enabling imaging of first demarcation elements on a first side of a media;

(b) enabling imaging of second demarcation elements on a second side of the media;

(c) receiving correction indicia based on which first demarcation element most closely aligns with which second demarcation element; and, (d) modifying imaging parameters of the imaging device based on the correction indicia.

13. A method of aligning duplex images on an imaging device, comprising:

(a) imaging first demarcation elements on a first side of a media;

(b) imaging second demarcation elements on a second side of the media;

(c) comparing the first and second demarcation elements in a single visual context to determine which first demarcation element most closely aligns with which second demarcation element;

(d) determining correction indicia based on which first demarcation element most closely aligns with which second demarcation element; and, (e) modifying imaging parameters of the imaging device based on the correction indicia.

14. The method of claim 13 wherein the first demarcation elements are included in a first portion of a vernier scale and the second demarcation elements are included in a second portion of the vernier scale.

15. The method of claim 13 wherein the comparing in the single visual context includes visually detecting the second demarcation elements through the media.

16. The method of claim 13 wherein the correction indicia is indicative of an instruction for modifying the imaging parameters of the imaging device.

17. The method of claim 13 further including entering the correction indicia into the imaging device at a control panel of the imaging device for modifying the imaging parameters of the imaging device.

18. The method of claim 13 wherein the imaging parameters include timing parameters associated with a process of imaging data on the imaging device.

19. A method of aligning duplex images on an imaging device, comprising:

(a) duplex imaging a test sheet having indicia on each side of the sheet that communicate, in a single visual context, duplex imaging adjustment parameters for the imaging device; and, (b) modifying imaging parameters of the imaging device based on the imaging adjustment parameters.

20. The method of claim 19 wherein the indicia on each side of the sheet includes respective portions of a vernier scale.

21. The method of claim 19 wherein the imaging parameters include timing parameters associated with a process of imaging data on the imaging device.

22. An imaging device, comprising:

(a) a print engine;

(b) means for generating with the print engine first demarcation elements on a first side of a media, second demarcation elements on a second side of the same media, and correction indicia associated with the first or second demarcation elements, all configured to communicate duplex image alignment indicia when viewed in a single visual context on the media; and, (c) means for modifying imaging parameters of the imaging device based on the correction indicia for aligning duplex imaging of the imaging device.

23. The imaging device of claim 22 wherein the imaging device is a printer, copier or facsimile device.

24. The imaging device of claim 22 wherein the first demarcation elements include a first portion of a vernier scale and the second demarcation elements include a second portion of the vernier scale.

25. The imaging device of claim 22 further including a control panel coupled to the print engine, and wherein certain of the correction indicia used for modifying the imaging parameters includes correction indicia associated with certain of the first demarcation elements that most closely align with certain of the second demarcation elements.

26. The imaging device of claim 22 wherein the imaging parameters include timing parameters associated with a process of imaging data on the imaging device.

27. An imaging device, comprising:

(a) means for duplex imaging a test sheet having indicia on each side of the sheet that communicate, in a single visual context, duplex imaging adjustment parameters for the imaging device; and, (b) means for modifying imaging parameters of the imaging device based on the imaging adjustment parameters.

28. An imaging device, comprising:

(a) a print engine;

(b) a memory coupled to the print engine; and, (c) instructions stored in the memory and configured to:

(i) enable duplex imaging of a test sheet with the print engine, the test sheet configured with indicia on each side of the sheet that communicate, in a single visual context, duplex imaging adjustment parameters for the imaging device; and, (ii) enable modifying of imaging parameters of the imaging device based on the imaging adjustment parameters.

* * * * *